US010033083B1

(12) United States Patent
Simons et al.

(10) Patent No.: US 10,033,083 B1
(45) Date of Patent: Jul. 24, 2018

(54) KA-BAND WAVEGUIDE HYBRID DIVIDER WITH UNEQUAL AND ARBITRARY POWER OUTPUT RATIO

(71) Applicant: The United States of America as represented by the Administrator of NASA, Washington, DC (US)

(72) Inventors: Rainee N. Simons, North Olmsted, OH (US); Christine T. Chevalier, Cleveland, OH (US); Edwin G. Wintucky, Willoughby, OH (US); Jon C. Freeman, Beachwood, OH (US)

(73) Assignee: The United States of America as Represented by the Administrator of National Aeronautics and Space Administration, Washington, DC (US)

( * ) Notice: Subject to any disclaimer, the term of this patent is extended or adjusted under 35 U.S.C. 154(b) by 30 days.

(21) Appl. No.: 15/293,680

(22) Filed: Oct. 14, 2016

Related U.S. Application Data

(63) Continuation of application No. 12/879,713, filed on Sep. 10, 2010, now Pat. No. 9,484,613.

(60) Provisional application No. 61/299,598, filed on Jan. 29, 2010.

(51) Int. Cl.
*H01P 5/12* (2006.01)
*H01P 1/213* (2006.01)
*H01P 5/04* (2006.01)

(52) U.S. Cl.
CPC ..... *H01P 5/12* (2013.01); *H01P 1/213* (2013.01); *H01P 5/04* (2013.01)

(58) Field of Classification Search
CPC ..... H01P 5/12; H01P 5/04; H01P 1/213
USPC ..... 333/110, 117, 125–128; 330/124 R
See application file for complete search history.

(56) References Cited

U.S. PATENT DOCUMENTS

| | | | | |
|---|---|---|---|---|
| 3,928,806 | A * | 12/1975 | Carter | H01P 1/362 330/124 D |
| 3,976,958 | A * | 8/1976 | Seidel | H03H 7/18 327/552 |
| 4,710,733 | A * | 12/1987 | Crill | H03C 7/02 332/144 |
| 5,229,728 | A | 7/1993 | Carvalho et al. | |
| 6,242,984 | B1 | 6/2001 | Stones et al. | |
| 6,828,785 | B2 | 12/2004 | Channabasappa et al. | |
| 7,385,462 | B1 | 6/2008 | Epp et al. | |
| 7,486,141 | B2 | 2/2009 | Do et al. | |
| 2004/0108903 | A1 | 6/2004 | Channabasappa et al. | |

(Continued)

*Primary Examiner* — Rakesh Patel
(74) *Attorney, Agent, or Firm* — Robert H. Earp, III; William M. Johnson

(57) ABSTRACT

One or more embodiments of the present invention describe an apparatus and method to combine unequal powers. The apparatus includes a first input port, a second input port, and a combiner. The first input port is operably connected to a first power amplifier and is configured to receive a first power from the first power amplifier. The second input port is operably connected to a second power amplifier and is configured to receive a second power from the second power amplifier. The combiner is configured to simultaneously receive the first power from the first input port and the second power from the second input port. The combiner is also configured to combine the first power and second power to produce a maximized power. The first power and second power are unequal.

16 Claims, 19 Drawing Sheets

(56) References Cited

U.S. PATENT DOCUMENTS

| | | | | |
|---|---|---|---|---|
| 2006/0066468 | A1* | 3/2006 | Iszley ..... | G01S 7/022<br>342/20 |
| 2007/0133083 | A1 | 6/2007 | Kangaslahti et al. | |
| 2007/0295314 | A1 | 12/2007 | Dong | |
| 2009/0231055 | A1 | 9/2009 | Lopez et al. | |

* cited by examiner

KA-BAND WAVEGUIDE HYBRID DIVIDER WITH UNEQUAL AND ARBITRARY POWER OUTPUT RATIO

CROSS-REFERENCE TO RELATED APPLICATION

This application is a Continuation Application claiming the benefit of priority from U.S. patent application Ser. No. 12/879,713, filed on Sep. 10, 2010, pending, which claims priority to U.S. Patent Application No. 61/299,598, entitled "Ka-Band Waveguide 2-Way Hybrid Combiner for MMIC Amplifiers With Unequal and Arbitrary Power Output Ratio", filed on Jan. 1, 2010, each of which is hereby incorporated by reference in its entirety.

ORIGIN OF THE INVENTION

The invention described herein was made by employees of the United States Government and may be manufactured and used by or for the Government for Government purposes without the payment of any royalties thereon or therefore.

The invention described herein was also made in the performance of work under NASA contract and is subject to the provisions of Section 305 of the National Aeronautics and Space Act of 1958, Public Law 85-568 (72 Stat. 435; 42 U.S.C. 2457).

FIELD

The present invention is related to an apparatus and a method for combining power. More specifically, the present invention is related to an apparatus and a method for combining power from two or more unequal power amplifiers.

BACKGROUND

High power Ka-Band solid-state power amplifiers (SSPA) are generally required for communications from deep space to Earth. The highest power Ka-Band (31.8 to 32.3 GHz) SSPA to have been used in space to date had a power output of 2.6 watts and an overall efficiency of 14.3 percent. This SSPA was built around discrete Gallium Arsenide (GaAs) Pseudomorphic High Electron Mobility Transistor (pHEMT) devices and was implemented onboard Deep Space One spacecraft. Since that time, monolithic microwave integrated circuit (MMIC) power amplifier (PA) technology has advanced. The state-of-the-art (SOA) GaAs pHEMT-based MMICs are generally capable of delivering radio frequency (RF) power in a range from 3 watts with a power added efficiency (PAE) of 32 percent to 6 watts with a PAE of 26 percent, at Ka-Band frequencies. To achieve power levels higher than 6 watts, the output of several MMIC PAs must be combined using a power combiner.

SUMMARY

Certain embodiments of the present invention may provide solutions to the problems and needs in the art that have not yet been fully identified, appreciated, or solved by current power combiners. For example, certain embodiments of the present invention provide an unequal power combiner having a low insertion loss with a high combining efficiency. This is one example of a feature that currently available power combiners cannot achieve.

In accordance with an embodiment of the present invention, an apparatus for combining power is provided. The apparatus includes a first input port, a second input port, and a combiner. The first input port is configured to receive a first power from the first power amplifier. The second input port is configured to receive a second power from the second power amplifier. The combiner is configured to simultaneously receive the first power from the first input port and the second power from the second input port. The combiner is also configured to combine the first power and second power to produce a maximized power. The first power and second power are unequal.

In accordance with another embodiment of the present invention, a method for combining power is provided. The method includes receiving, at a first input port, a first power from a first power amplifier. The method also includes receiving, at a second input port, a second power from a second power amplifier. The method further includes simultaneously receiving, at a combiner, the first power from the first input port and the second power from the second input port. In addition, the method includes combining, at the combiner, the first power and second power to produce a maximized power. The first power and second power are unequal.

In yet another embodiment of the present invention, another apparatus for combining power is provided. The apparatus includes a combiner comprising a first input port, a second input port, an output port, and an isolated port. The combiner is configured to simultaneously receive a first power from a first power amplifier, via the first input port, and a second power from a second power amplifier, via the second input port. The first power and second power are unequal. The combiner is also configured to combine the first power and the second power to generate a maximized power.

BRIEF DESCRIPTION OF THE DRAWINGS

For proper understanding of the present invention, reference should be made to the accompanying figures. These figures depict only some embodiments of the invention and are not limiting of the scope of the invention. Regarding the figures.

DETAILED DESCRIPTION OF THE EMBODIMENTS

Figure 1:
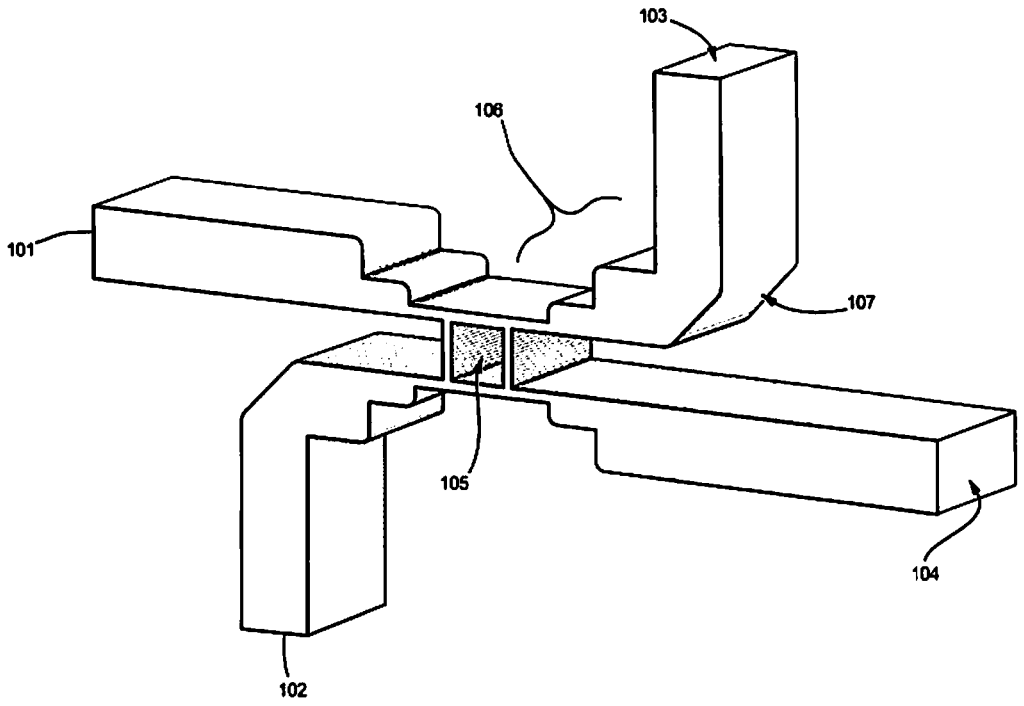
FIG. 1 illustrates a 2-way power combiner, in accordance with an embodiment of the present invention.

It will be readily understood that the components of the present invention, as generally described and illustrated in the figures herein, may be arranged and designed in a wide variety of different configurations. Thus, the following detailed description of the embodiments, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of "certain embodiments," "some embodiments," or other similar language, throughout this specification refers to the fact that a particular feature, structure, or characteristic described in connection with the embodiment may be included in at least one embodiment of the present invention. Thus, appearances of the phrases "in certain embodiments," "in some embodiments," "in other embodiments," or other similar language, throughout this specification do not necessarily all refer to the same embodiment or group of embodiments, and the described features, structures, or characteristics may be combined in any suitable manner in one or more embodiments.

As briefly discussed above, in order to achieve power levels higher than 6 watts, the output power from several monolithic microwave integrated circuit (MMIC) power amplifiers (PA) have to be combined using a power combiner. However, conventional binary waveguide power combiners, such as short slot and magic-T based power combiners, require MMIC PAs with identical amplitude and phase characteristics for high combining efficiency. In addition, due to manufacturing process variations, the output power of the MMIC PAs tends to be unequal. As a result, it may be beneficial to develop an unequal power combiner.

The embodiments of the present invention describe a novel Ka-Band high efficiency asymmetric waveguide power combiner. For example, a four-port combiner can be used for coherent combining of two MMIC solid state power amplifiers (SSPAs) having unequal outputs over frequency bands from 31.8 to 32.3 GHz. For instance, 2 watts of power from a MMIC PA and 1 watt of power from another MMIC PA are combined in the power combiner to produce 3 watts of power. The measured combiner efficiency can be greater than 90 percent with a return loss greater than 18 dB and input port isolation greater than 22 dB. Some embodiments of the present invention also describe a power combiner having an input power ratio of 2:1. However, a person of ordinary skill in the art would appreciate that the power combiner can be custom designed for any arbitrary power ratio and is also not limited to a Ka-Band high efficiency asymmetric waveguide power combiner. The power combiner can also be configured for any frequency or have any waveguide output (e.g., rectangular or circular). The power combiner described herein can address, but not limited to, communication systems needing 6 to 10 watts of radio frequency (RF) power.

FIG. 1 illustrates a 2-way power combiner 100, in accordance with an embodiment of the present invention. In particular, FIG. 1 illustrates a Ka-Band branch-line hybrid power combiner 100 comprising a plurality of ports 101, 102, 103 and 104 and a combiner 105 with an arbitrary power combining ratio and port impedance. The impedance of ports 101, 102, 103 and 104 is matched to that of a standard WR-28 waveguide by using an E-plane stepped impedance transformer. A person of ordinary skill in the art will appreciate that any of ports 101, 102, 103 and 104 can serve as an output port or input port. In addition, each port 101, 102, 103 and 104 can be interfaced with standard test equipment or standard microwave equipment, such as a power amplifier.

FIG. 1 also illustrates steps 106 and a right angle bend 107. Steps 106, as well as right angle bend 107 are configured to facilitate testing and integration with standard waveguide components. For instance, steps 106 are used for impedance matching of combiner 105 with port 103. The slant in steps 106 is used to match steps 106 with port 103. Right angle bend 107 is configured to facilitate testing with standard waveguide components.

Combiner 105 can be configured to have different power-combining ratios such as 1.5:1, 2:1, 3:1, or any desired ratio. For example, if combiner 105 has a power-combining ratio of 2:1, then a power signal fed into port 103 can be twice that of a power signal fed into the port 104. It should be appreciated that the dimensions of combiner 105 are dependent on the frequency being used. For example, as frequency increases, the wavelength decreases, and, if the wavelength decreases, then the dimensions of combiner 105 change.

It should also be appreciated that power combiner 100 shown in FIG. 1 can be utilized as a power divider. When operating as a power divider, a signal source, such as a MMIC PA, is operably connected to port 101. In this embodiment, because the power divider is a two-way power divider, port 101 is an input port and ports 103 and 104 are output ports. Port 102 is an isolated port, or otherwise grounded or match terminated, so zero power is received at port 102. For example, when 3 watts of power are fed into port 101, the power divider divides power at divider 105 so half the power is outputted from port 103 and the other half of the power is outputted from port 104.

If, however, the power divider is set to have a power ratio of 2:1, then power outputted from port 103 is two times the amount of power outputted from port 104. For example, if the power divider divides 3 watts of power, then 2 watts of power are outputted from port 103 and 1 watt of power is outputted from port 104. In other words, the power divider can be configured to divide power unequally.

Figure 2A:
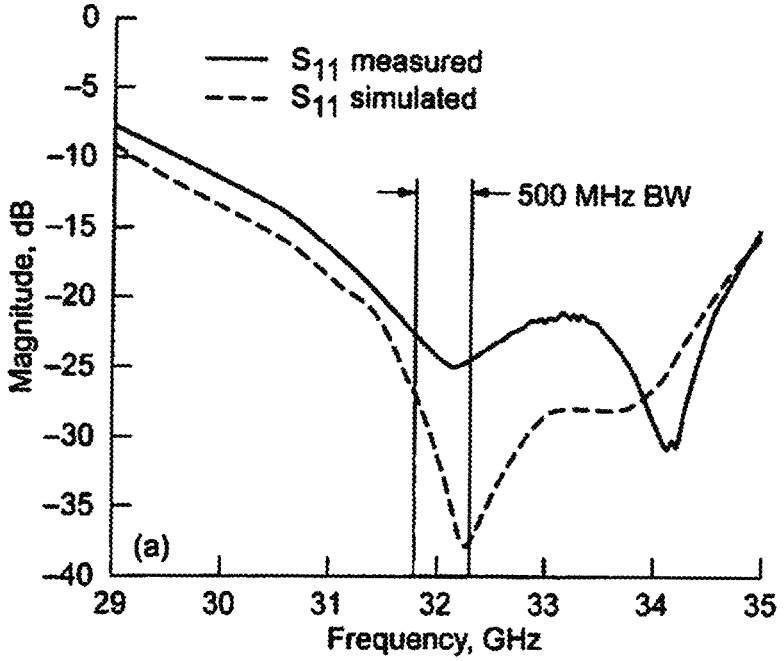
FIG. 2A a graph of measured and simulated return loss at input port 101 of FIG. 1 as a function of frequency when a power combiner is used as a power divider, in accordance with an embodiment of the present invention.

FIG. 2A illustrates a graph of measured and simulated return loss ($S_{11}$ measured, $S_{11}$ simulated) at input port 101 of FIG. 1 as a function of frequency when power combiner 100 is used as a power divider, in accordance with an embodiment of the present invention. In particular, FIG. 2A shows the amount of measured power and simulated power that is reflected back at input port 101 of FIG. 1, when feeding in power at input port 101. The frequency range shown in FIG. 2A ranges from 29 gigahertz (GHz) to 35 GHz. However, the bandwidth (BW) of interest is around 500 megahertz (MHz), which extends from 31.8 GHz to 32.3 GHz. According to the graph shown in FIG. 2A, measured and simulated results are greater than 20 dB in the 500 MHz BW. In other words, less than one percent of power is reflected back to input port 101, and more than ninety-nine percent of the power is transmitted in the desired direction. Because less than one percent of power is reflected back to input port 101, the power divider is considered to be highly efficient.

Figure 2B:
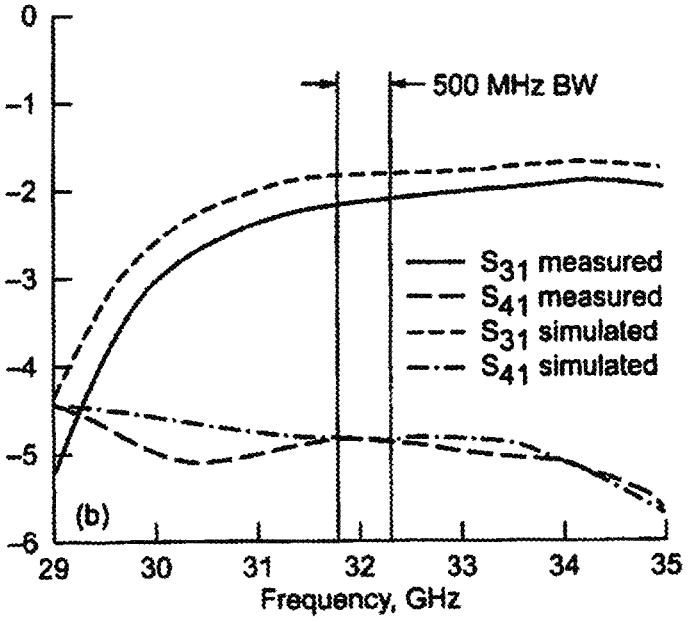
FIG. 2B illustrates a graph of measured and simulated amplitudes of a signal coupled to output port 103 and output port 104 as a function of frequency when a power combiner is used as a power divider, in accordance with an embodiment of the present invention.

FIG. 2B illustrates a graph of measured and simulated amplitudes of a signal coupled to output port 103 ($S_{31}$) and output port 104 ($S_{41}$) as a function of frequency when power combiner 100 is used as a power divider, in accordance with an embodiment of the present invention. Because the power divider is an unequal power divider, the graph of FIG. 2B shows an output power ratio of 2:1, meaning that the measured power outputted from output port 103 is twice that of the measured power outputted from output port 104. FIG. 2B also shows that actual measurements $S_{31}$ and simulated measurements $S_{31}$ to have a small discrepancy, while actual measurements $S_{41}$ and simulated measurements $S_{41}$ coincide in the bandwidth of interest. The reason for the small discrepancy is due to the dimensional intolerances of the power divider.

Figure 2C:
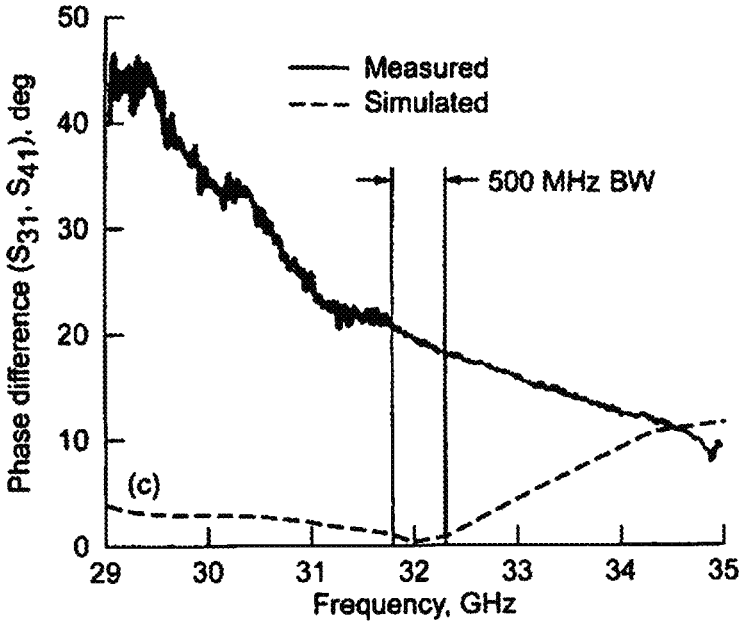
FIG. 2C illustrates a graph of measured and simulated phase differences of a signal coupled to output port 103 and output port 104 as a function of frequency when a power combiner is used as a power divider, in accordance with an embodiment of the present invention.

FIG. 2C illustrates a graph of measured and simulated phase differences of a signal coupled to output port 103 and output port 104 (phase of $S_{31}$-phase of $S_{41}$) as a function of frequency when power combiner 100 is used as a power divider, in accordance with an embodiment of the present invention. In this embodiment, a phase of the power signal is measured at output port 103 and a phase of the power signal is measured at output port 104, and then the difference between the measured phases is taken into account. For example, the graph shown in FIG. 2C illustrates that over the 500 MHz BW, the phase difference is around 20 degrees for the power signals appearing at output port 103 and output port 104. However, under a computer-simulated model, the simulated phase difference is zero degrees. The difference between the simulated measurement and the actual measurement is due to imperfections in manufacturing tolerances and measurement accuracies. It should be noted that this information is useful when using power combiner 100 to combine power. For example, based on the graph shown in FIG. 2C, when combining power that is fed in from ports 103 and 104, the phase difference of about 20 degrees can be compensated through an external phase shifter so that the power signals from port 103 and port 104 overlap in combiner 105, thereby maximizing the combined power.

Figure 2D:
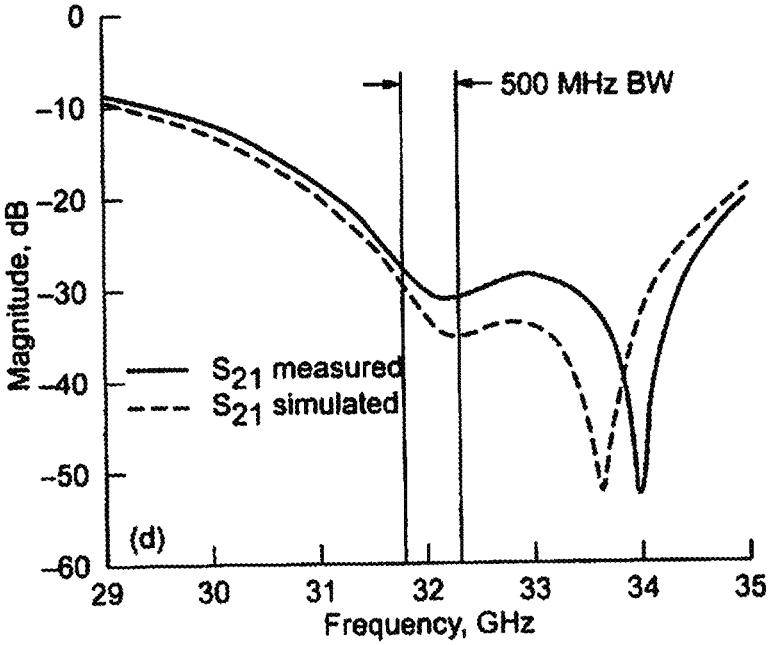
FIG. 2D illustrates a graph of measured and simulated signal isolation between input port 101 and isolated port 102 as a function of frequency when a power combiner is used as a power divider, in accordance with an embodiment of the present invention.

FIG. 2D illustrates a graph of measured and simulated signal isolation between input (excitation) port 101 and isolated port 102 ($S_{21}$) as a function of frequency when power combiner 100 is used as a power divider, in accordance with an embodiment of the present invention. In particular, FIG. 2D shows the signal isolation between input port 101 and isolated port 102. Ideally, isolated port 102 should receive zero power, as isolated port 102 is grounded or match terminated. To validate this, the graph in FIG. 2D shows that power is measured at isolated port 102 while power is fed in at input port 101. The measured power at isolated port 102 is approximately 30 dB, which means that less than 0.1 percent of the power is coupled to isolated port 102. This is considered to be excellent because the loss of power is very small. The graph shown in FIG. 2D also indicates that the computer-simulated model ($S_{21}$) shows a similar result, thereby validating that isolated port 102 receives very little or negligible power.

Figure 2E:
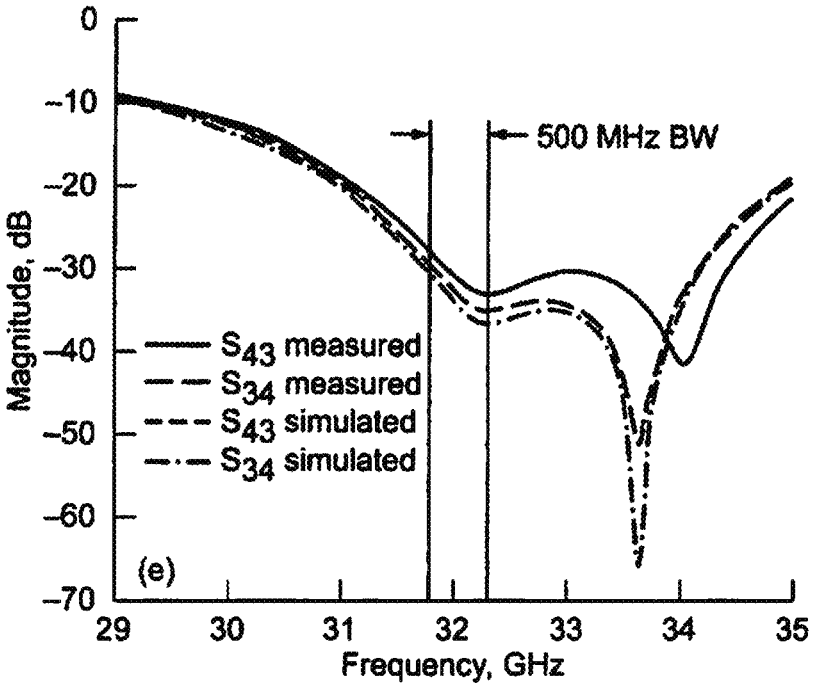
FIG. 2E illustrates a graph of measured and simulated isolation between output port 103 and output port 104 as a function of frequency when a power combiner is used as a power divider, in accordance with an embodiment of the present invention.

FIG. 2E illustrates a graph of measured and simulated isolation between output port 103 and output port 104 ($S_{43}$, $S_{34}$) as a function of frequency when the power combiner 100 is used as a power divider, in accordance with one or more embodiments of the present invention. In this embodiment, output ports 103 and 104 should be sufficiently isolated because if one of the power amplifiers attached to either output ports 103 or 104 when used as a combiner malfunctions, then the other port should still be functioning. The graph shown in FIG. 2E indicates that output ports 103 and 104 are isolated by at least more than 30 dB, which means that the two power amplifiers are isolated by 30 dB or better. This means that if one of the amplifiers fails, then the other amplifier can still function properly. In other words, output ports 103 and 104 are sufficiently decoupled.

Returning to FIG. 1, the following description briefly describes the functionality of power combiner 100, when used as a combiner. In this embodiment, power is supplied or fed into input ports 103 and 104 and combined at combiner 105 so that output port 101 can output a combined maximized power. Because port 102 is isolated, very little or no power flows to port 102. Such an unequal power combiner 100 allows unequal power to be fed into multiple ports so that unequal power can be combined into a maximized power.

Figure 3:
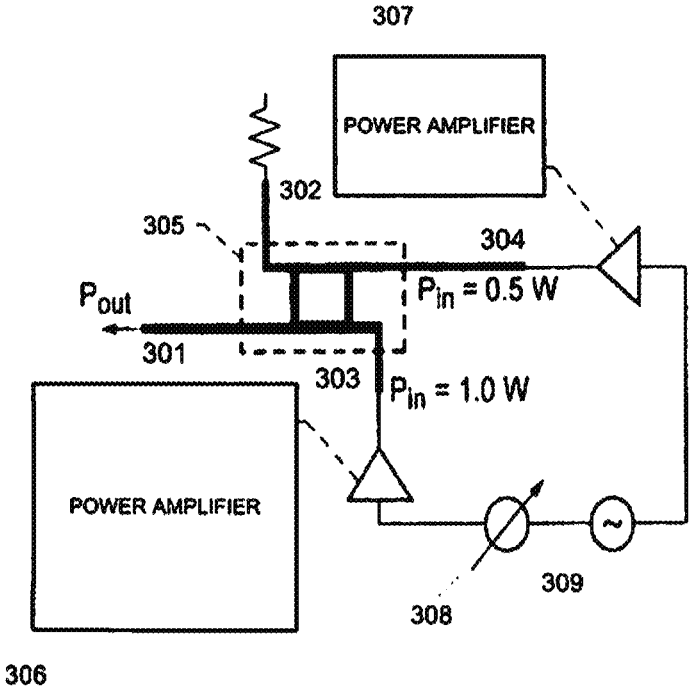
FIG. 3 illustrates a 2-way power combiner circuit, in accordance with an embodiment of the present invention.

FIG. 3 illustrates a 2-way power combiner circuit, in accordance with an embodiment of the present invention. More particularly, FIG. 3 is a schematic experimental setup for demonstrating power combining of MMIC PAs with unequal power output using a branch-line hybrid power combiner.

FIG. 3 illustrates a power combiner 305 with four ports 301, 302, 303 and 304. Port 301 is an output port ($P_{out}$), port 302 is an isolated port, which is match terminated or grounded, and ports 303 and 304 are input ports ($P_{in}$). Power amplifiers 306 and 307 are operably connected to ports 303 and 304. In this example, power amplifier 306 generates more power than power amplifier 307. To illustrate the discrepancy in power, FIG. 3 shows that power amplifier 306 is larger in size than power amplifier 307. A frequency synthesizer 309 also referred as a signal synthesizer or signal generator is operably connected to power amplifiers 306 and 307. A phase shifter 308 is operably connected to power amplifier 306 and frequency synthesizer 309.

Frequency synthesizer 309 generates a power signal that is transmitted to power amplifier 306 and another power signal that is transmitted to power amplifier 307. The generated power signals are configured to supply sufficient power to drive power amplifiers 306 and 307. Phase shifter 308 is utilized in order to achieve an appropriate phase because of the unintended phase difference between ports 303 and 304. For example, because dimensional tolerance can cause port 304 and port 303 to have a phase difference. In addition, power amplifiers 306 and 307 are unequal in output power and phase. Hence, power signals entering ports 303 and 304 will reach the power combiner 305 with different phase. In order for power signals to reach the power combiner 305 in the same phase, phase shifter 308 is configured to adjust the phase of the power signal to an appropriate phase level.

In this embodiment, power amplifier 306 generates 1 watt of power and power amplifier 307 generates 0.5 watts of power. 1 watt of power is fed into port 303 and 0.5 watts of power is fed into port 304. Power combiner 305 is configured to combine the wattage received from ports 303 and 304. For example, power combiner 305 is configured to combine 1 watt received from port 303 and 0.5 watts received from port 304 into 1.5 watts. The combined wattage of 1.5 can then be outputted at port 301 with port 302 receiving very little or no power. Stated another way, FIG. 3 shows a power combiner configured to combine unequal power received from two power amplifiers.

Figure 4A:
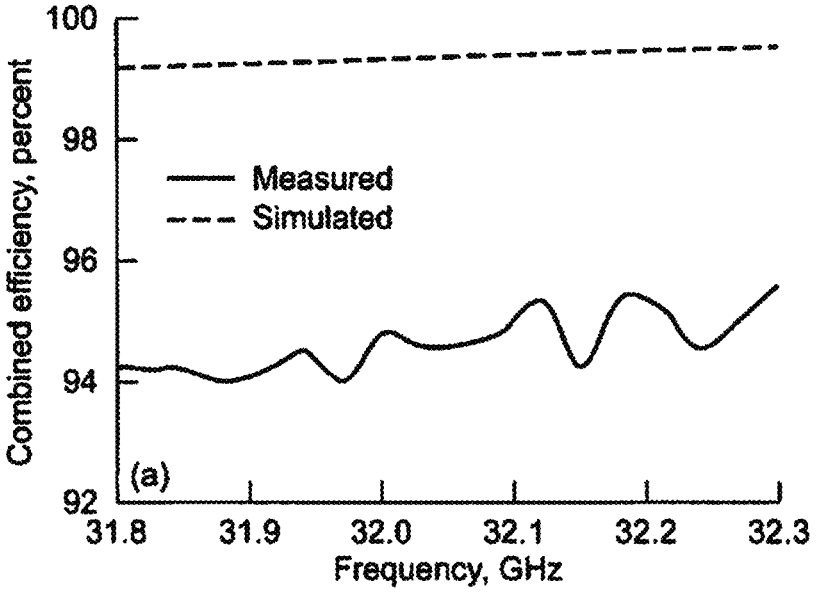
FIG. 4A illustrates a graph showing measured and simulated combiner efficiency as a function of frequency, in accordance with an embodiment of the present invention.

FIG. 4A illustrates a graph showing measured and simulated combiner efficiency as a function of frequency, in accordance with an embodiment of the present invention. In particular, the graph shown in FIG. 4A illustrates that, when power from input ports 303 and 304 of FIG. 3 are combined, the combined efficiency is greater than ninety-four percent over 500 MHz BW. A combined efficiency of greater than ninety-four percent is considered to be excellent, because very little power is lost when two unequal powers are combined. It should be noted that the data used to generate the graph shown in FIG. 4A is based on the combiner being used as a divider. In other words, to generate the graph shown in FIG. 4A, data from graphs in FIG. 2A-E was used.

Figure 4B:
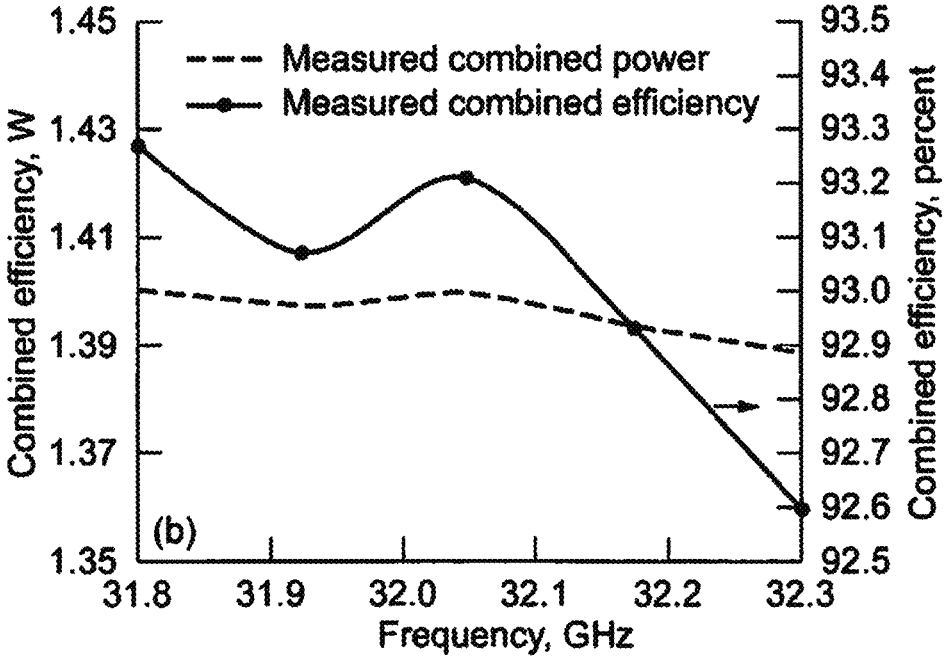
FIG. 4B illustrates a graph showing measured combiner output power and combiner efficiency as a function of frequency, in accordance with an embodiment of the present invention.

FIG. 4B illustrates a graph showing measured combiner output power and combiner efficiency as a function of frequency, in accordance with an embodiment of the present invention. The graph shown in FIG. 4B illustrates that 1.0 watt of power being combined with 0.5 watts of power produces approximately 1.4 watts of power. In other words, there is a loss of about 0.1 watts of power, which translates into an efficiency of greater than ninety percent over a frequency range of 31.8 GHz to 32.3 GHz. This graph further establishes that the power combiner from FIG. 3 is efficient, because very little power is lost.

Figure 4C:
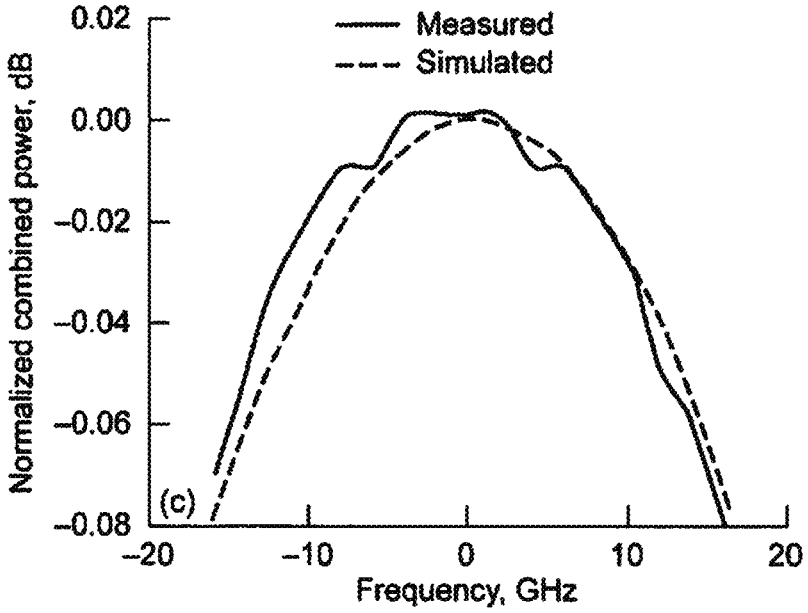
FIG. 4C illustrates a graph showing measured and simulated normalized combiner output power as a function of input phase difference at 32.05 GHz, in accordance with an embodiment of the present invention.

FIG. 4C illustrates a graph showing measured and simulated normalized combiner output power as a function of input phase difference at 32.05 GHz, in accordance with an embodiment of the present invention. As discussed above in FIG. 2C, a phase difference of twenty degrees is realized for the power combiner shown in FIG. 1 when used as a divider. However, when used as a combiner, the phase difference of twenty degrees is calibrated to zero degrees.

Moreover, because the power amplifiers attached to the input ports of the power combiner begin to drift in phase over a period of time, the graph shown in FIG. 4C illustrates what happens to the combined power when the drifts in phase occur by plus or minus twenty degrees. In particular, the graph shows that the combined power merely changes by 0.08 dB when the phase shifts by plus or minus twenty degrees. In other words, the graph shows that the power combiner performs well in a harsh or difficult environment, thus making the power combiner is extremely durable.

Figure 5:
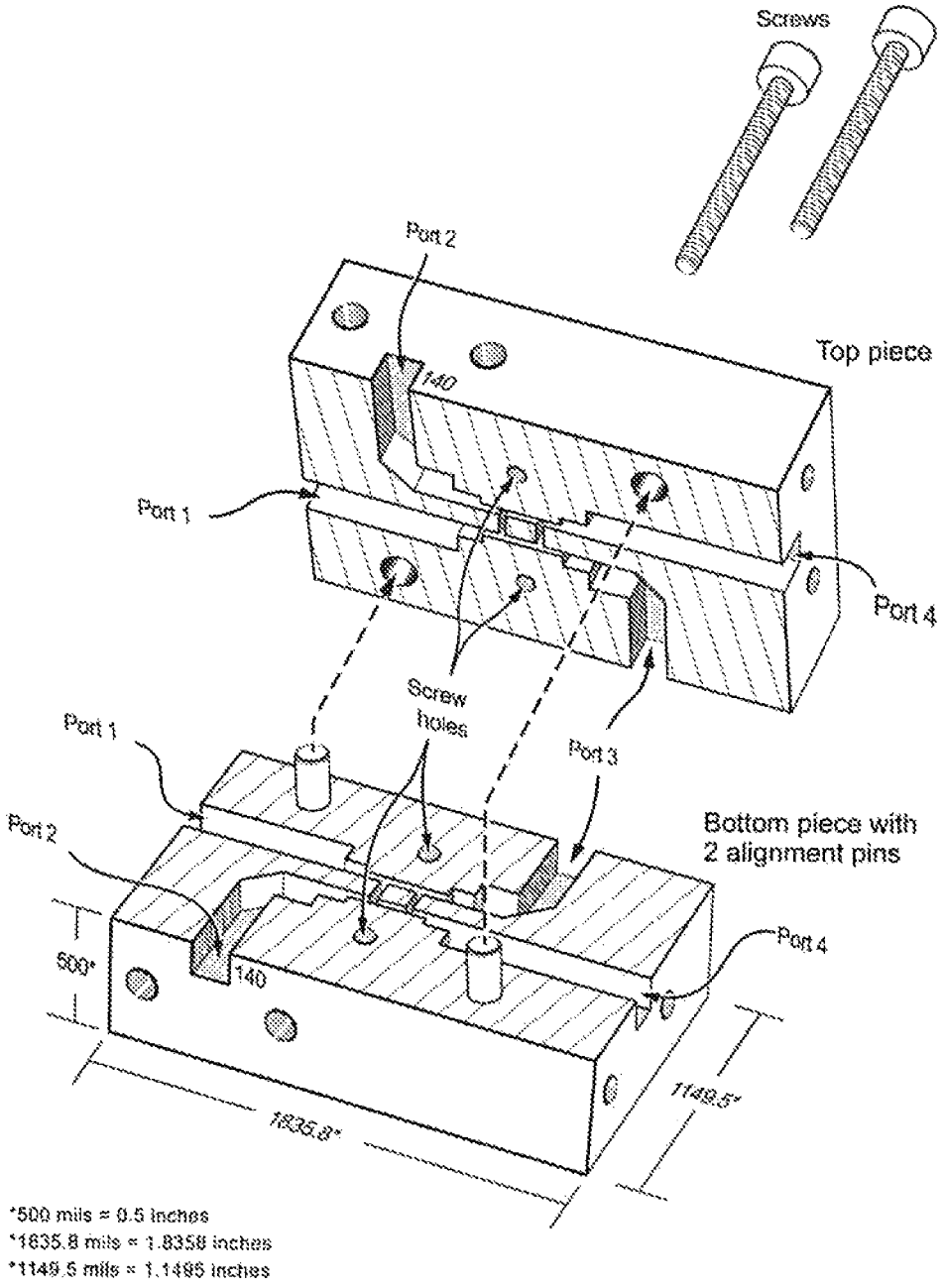
FIG. 5 illustrates an unequal Ka-Band branch-line hybrid power combiner in an E-plane split block arrangement, in accordance with an embodiment of the present invention.

FIG. 5 illustrates an unequal Ka-Band branch-line hybrid power combiner in an E-plane split block arrangement, in accordance with an embodiment of the present invention. The hybrid combiner includes a top piece 500A and a bottom piece 500B. Top piece 500A includes a plurality of ports 501A, 502A, 503A and 504A, a combiner 505A, and screw holes 506A and 507A. Bottom piece 500B also includes a plurality of ports 501B, 502B, 503B and 504B, a combiner 505B, and screw holes 506B and 507B. In this embodiment, top piece 500A is placed on top of bottom piece 500B. Screws 508A and 508B are inserted through screw holes 506A and 506B and screw holes 507A and 507B, respectively, and tightened in order to form the hybrid power combiner.

Figure 6:
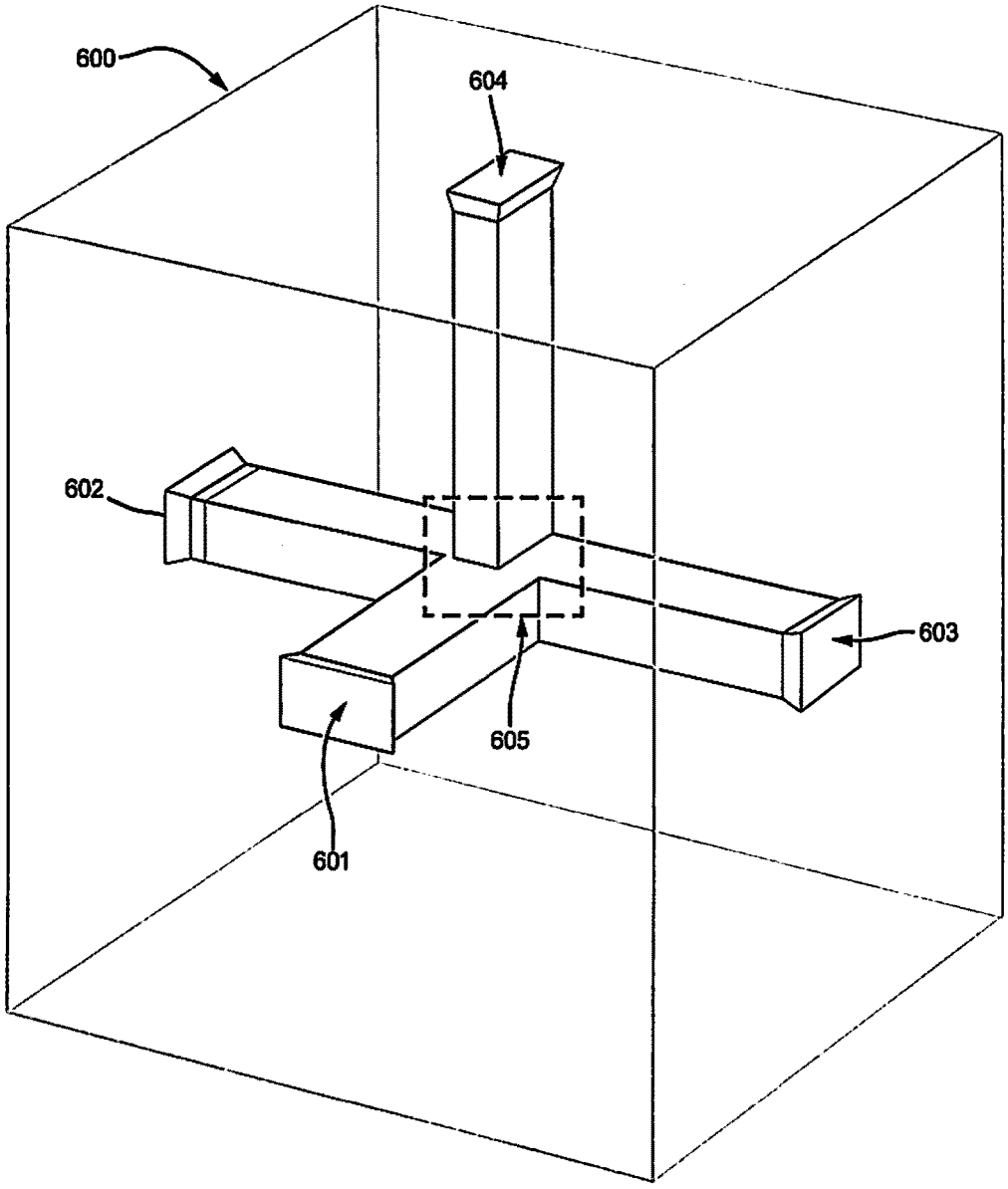
FIG. 6 illustrates a transparent view of a 2-way magic-T based unequal power combiner, in accordance with another embodiment of the present invention.

FIG. 6 illustrates a transparent view of a 2-way magic-T based unequal power combiner 600, in accordance with another embodiment of the present invention. The 2-way magic-T based unequal power combiner 600 includes a plurality of ports 601, 602, 603 and 604. In this embodiment, the internal structure of ports 601, 602, 603 and 604 are non-standard waveguides, as they are reduced height waveguides. As a result, a small taper has been added to the ends of ports 601 602, 603 and 604 to convert ports 601, 602, 603, and 604 into standard waveguides. This allows the power combiner to be interfaced with standard waveguide equipment or component, such as an antenna or any other communication system component. Power combiner 600 also includes a combiner 605, where two unequal powers inputted at ports 602 and 603 are combined. It should be appreciated that combiner 605 can be used as a divider.

In this embodiment, port 604 is an isolated port. In order to achieve sufficient isolation, a rectangular opening of port 604 is constructed to be at a right angle to the rectangular openings of ports 603, 604 and perpendicular to the rectangular opening of port 601. Port 604 is also rotated by ninety degrees and is also off center with respect to port 601 so as to achieve sufficient isolation. This configuration, as illustrated in FIG. 6, maximizes the amount of combined power being outputted at port 601 from ports 602 and 603.

Figure 7:
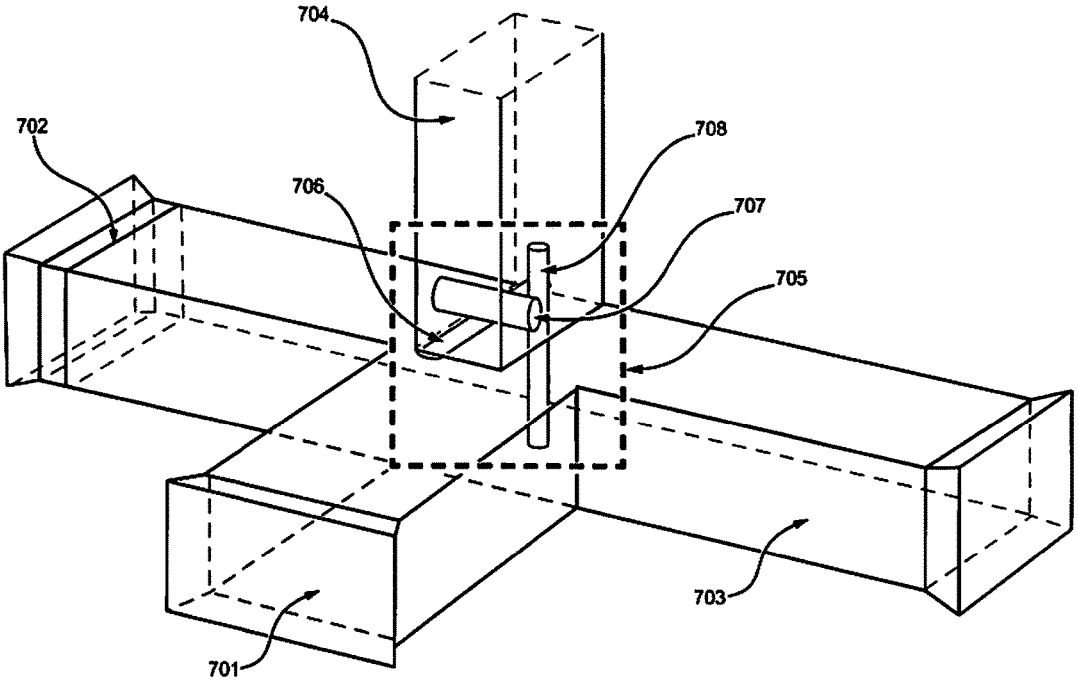
FIG. 7 illustrates another transparent view of a 2-way magic-T based unequal power combiner, in accordance with an embodiment of the present invention.

FIG. 7 illustrates another transparent view of a 2-way magic-T based unequal power combiner 700, in accordance with an embodiment of the present invention. The power combiner 700 includes a plurality of ports 701, 702, 703 and 704 and a combiner 705. Combiner 705 includes a capacitive iris 706, a horizontal rod 707, and a vertical inductive post 708. In this embodiment, in order to achieve a desired asymmetric power transmission, phase equality and high port isolation, capacitive iris 706 is constructed to be 0.65 by 0.08 mm, horizontal rod 707 is constructed to have a diameter of 0.8 mm, and vertical inductive post 708 is constructed to have a diameter of 0.5 mm and a height of 5.0 mm. However, it should be appreciated that other dimensions can be used to achieve a desired asymmetric power transmission, phase equality and high isolation.

In this embodiment, port 704 is an isolated port. Also, power combiner 700 shows an adjustment to the horizontal position of port 704 for a 2:1 power ratio. The distances of ports 702 and 703 from the junction with port 701 are adjusted to achieve an appropriate phase balance. Capacitive iris 706 width and inductive post 708 height are also adjusted to increase isolation and decrease reflection, respectively. It should be appreciated that the location of port 704 with respect to ports 702 and 703 is offset by 0.84 mm closer to port 703. To simultaneously optimize the combiner for low insertion loss, high isolation, and good impedance match over 32.05 GHz plus or minus 0.25 GHz, power combiner 700 is configured with non-standard internal dimensions for the waveguide (3.0 by 6.1 mm). To transition the non-standard waveguide into a standard WR-28 waveguide, a linear taper having a length of 1 mm is added to each port. It should be appreciated that power combiner 700 can be manufactured from aluminum and measures 40 by 39 by 39 mm. However, a person of ordinary skill in the art will appreciate that the dimensions can be changed to achieve a different power ratio and also change as the frequency changes.

Figure 8:
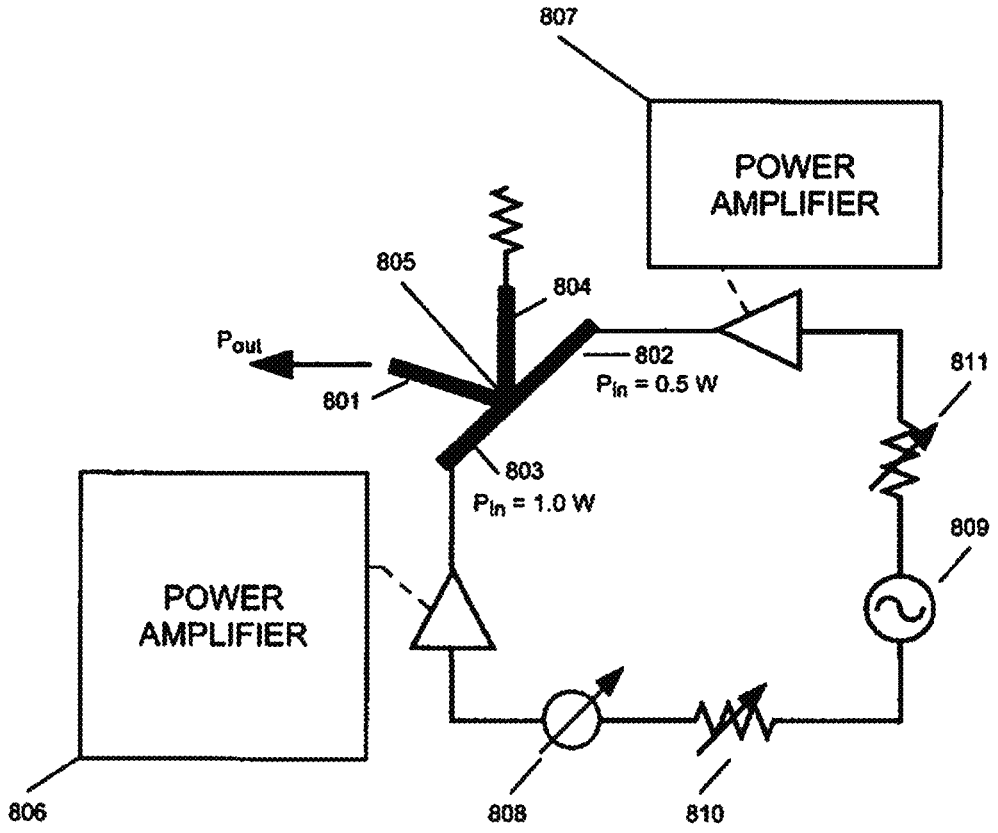
FIG. 8 illustrates a 2-way magic-T based unequal power combiner circuit, in accordance with an embodiment of the present invention.

FIG. 8 illustrates a 2-way magic-T based unequal power combiner circuit, in accordance with an embodiment of the present invention. In particular, FIG. 8 shows a schematic of a power combiner test circuit using an asymmetric combiner for the demonstration of power combining of two GaAs pHEMT MMIC PAs with unequal power. In this embodiment, the power combiner is configured to have a power combining ratio of 2:1. Frequency synthesizer 809 is used to transmit a small amplitude signal to drive power amplifier 806 and transmit another small amplitude signal to drive power amplifier 807. Attenuators 810 and 811 are used to adjust the amplitude of the signals for the 2:1 power ratio. Phase shifter 808 is configured to adjust phase of the signal. Power amplifier 806 amplifies and transmits the signal to port 803 and power amplifier 807 amplifies and transmits the other signal to port 804.

In other words, FIG. 8 shows that 1 watt of power generated from power amplifier 806 is inputted into port 803 and 0.5 watts of power generated from power amplifier 807 is inputted into port 802. Phase shifter 808 is configured such that the 1 watt of power and the 0.5 watts of power reach asymmetric coupler 805 at the same time in order to generate a maximized power. The combined power of 15 watts is then outputted at port 801. Because port 804 is isolated from port 801, negligible or no power is transmitted to port 804.

Figure 9A:
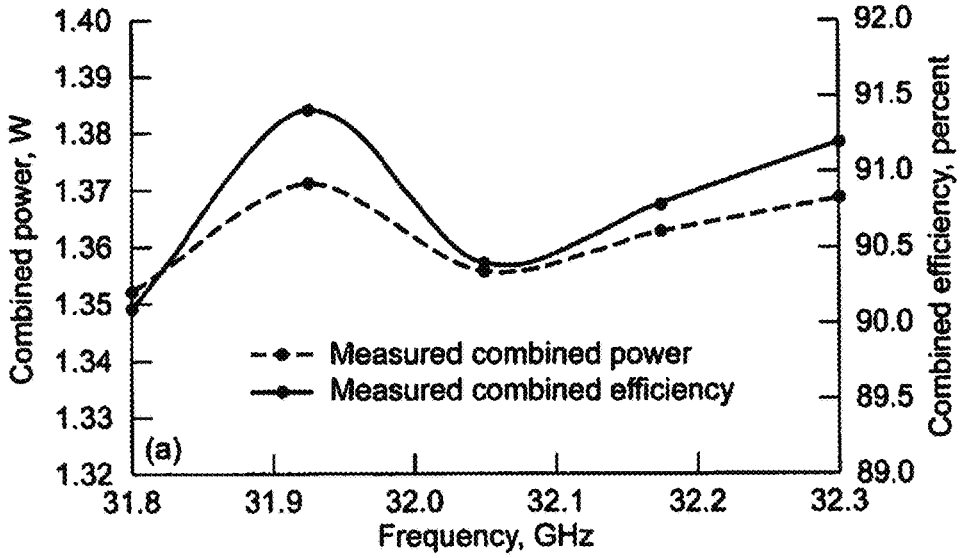
FIG. 9A illustrates a graph showing a combined power and a corresponding combiner efficiency measured across a frequency band of 31.80 GHz to 3230 GHz, in accordance with an embodiment of the present invention.

FIG. 9A illustrates a graph showing a combined power and a corresponding combiner efficiency measured across a frequency band of 31.80 GHz to 32.30 GHz, in accordance with an embodiment of the present invention. In particular, the graph shown in FIG. 9A illustrates the combined power and efficiency for a magic-T based unequal power combiner. In this graph, a frequency synthesizer is set to 31.8 GHz and a phase shifter is used to adjust the power signal in order to achieve a maximum power. FIG. 9A shows that over the frequency of interest for deep space exploration, the combined power is greater than 1.35 watts. Also, over the frequency of interest, the magic-T based unequal power combiner efficiency is greater than ninety percent. In other words, the combined power and efficiency of the magic-T based unequal power combiner is better than currently available power combiners.

Figure 9B:
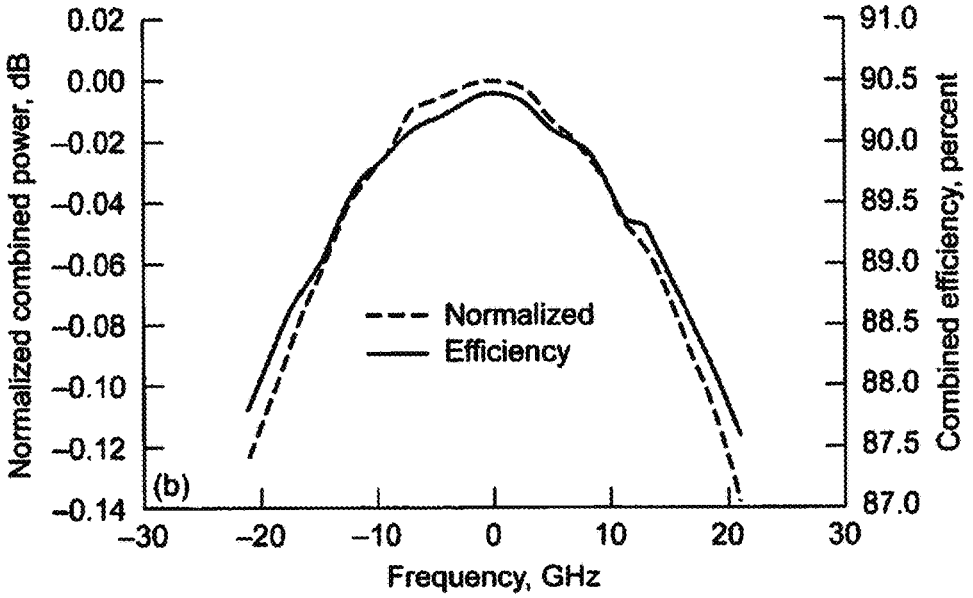
FIG. 9B illustrates a graph showing a measured combiner power and a corresponding combiner efficiency versus an imbalance in input power phase, in accordance with an embodiment of the present invention.

FIG. 9B illustrates a graph showing a measured combiner power and corresponding combiner efficiency versus an imbalance in input power phase, in accordance with an embodiment of the present invention. In particular, the graph in FIG. 9B shows the phase difference can be plus or minus 21 degrees. If the phase changes by plus or minus 21 degrees, then the combined power changes by approximately 0.12 dB and the combined power efficiency changes no less than 3 percent. Stated another way, the graph in FIG. 9B shows that the power combiner performs well in a harsh or difficult environment, thus making the power combiner is extremely durable. In addition, the graph in FIG. 9B shows that the power combiner can be used for a long period of time.

Figure 10:
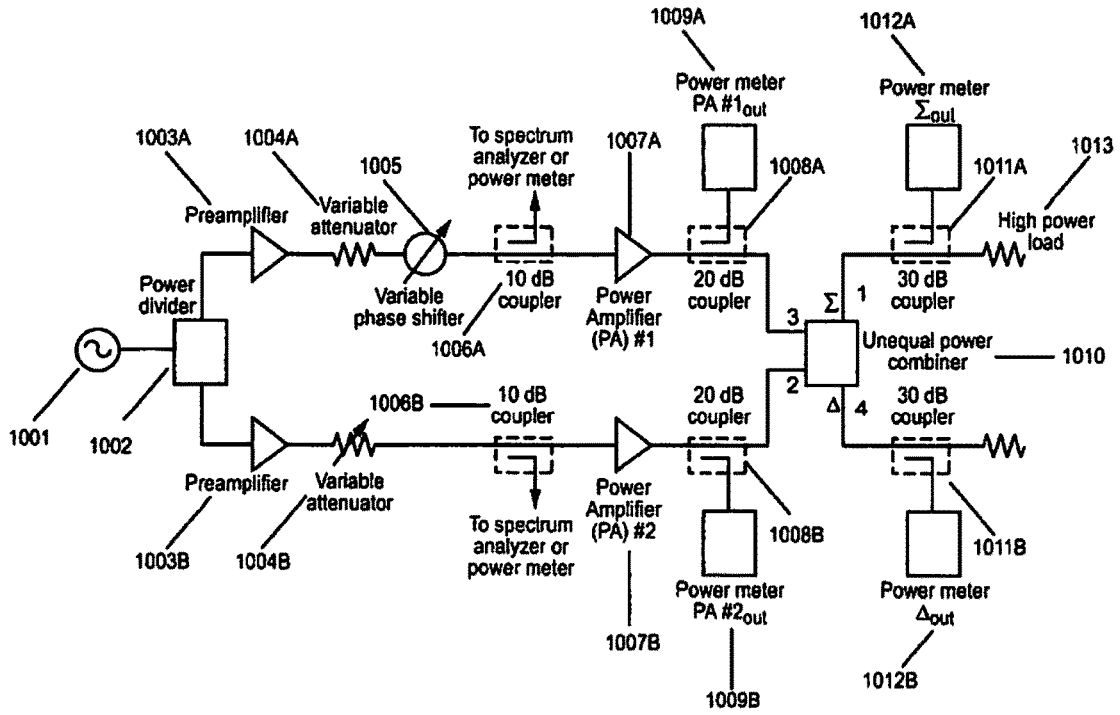
FIG. 10 illustrates a schematic of a 2-way power combining circuit, in accordance with one or more embodiments of the present invention.

FIG. 10 illustrates a schematic of a 2-way power combining circuit, in accordance with one or more embodiments of the present invention. The 2-way power combining circuit includes a signal synthesizer or generator 1001, a power divider (or splitter) 1002, preamplifiers 1003A and 1003B, variable attenuators 1004A and 1004B, a variable phase shifter 1005, couplers 1006A and 1006B, power amplifiers 1007A and 1007B, couplers 1008A and 1008B, power meters 1009A and 1009B, an unequal power combiner 1010, couplers 1011A and 1011B, power meters 1012A and 1012B, and high power load 1013.

Combiner 1010 can be an unequal magic-T based power combiner, an unequal branch-line hybrid power combiner, or any unequal power combiner in accordance with the present invention. For instance, combiner 1010 can be a 2:1 unequal power combiner, an N:1 unequal power combiner, or any type of power combiner. Combiner 1010 includes four ports, i.e., port 1, port 2, port 3, and port 4. Port 3 and port 2 are operably connected to power amplifier 1007A and power amplifier 1007B, respectively. Port 1 is configured to output combined (maximized) power and port 4 is configured to output negligible or no power.

Signal synthesizer 1001 generates a power signal, which is split equally into two power signals, a first power signal and a second power signal, by power divider 1002. In order to sufficiently drive power amplifiers 1007A and 1007B, the amplitude of the first power signal and the second power signal are adjusted by variable attenuators 1004A and 1004B. Also, depending on the power ratio being used, attenuators 1004A and 1004B accordingly adjust the amplitude of the first power signal and the second power signal. In other words, the amplified first power signal and the amplified second power signal are adjusted to provide sufficient power to drive power amplifiers 1007A and 1007B.

Phase shifter 1005 adjusts a phase of the amplified first power signal causing the stronger power signal generated by power amplifier 1007A and weaker power signal generated by power amplifier 1007B to overlap in combiner 1010. Couplers 1006A and 1006B, which can be a 10 dB coupler, allow power meters (or spectrum analyzers) to operably connect to the circuit so power inputted into power amplifiers 1007A and 1007B can be measured. Couplers 1008A and 1008B, which can be a 20 dB coupler, enable power meters (or spectrum analyzers) 1009A and 1009B to operably connect to the circuit, so power outputted from power amplifiers 1007A and 1007B can be measured.

Power amplifiers 1007A and 1007B are configured to generate unequal power in accordance with the unequal power ratio. For instance, power amplifier 1007A can be configured to generate a stronger power signal and power amplifier 1007B can be configured to generate a weaker power signal. The stronger power signal and weaker power signal are transmitted from power amplifiers 1007A and 1007B into combiner 1010 via ports 3 and 2, respectively. Combiner 1010 is configured to combine the stronger power signal and the weaker power signal to produce a maximized power signal. The maximized power signal is then outputted from port 1 (or sigma E) to high load 1013 while very little or negligible power is being outputted from port 4 (or delta A). Couplers 1011A and 1011B, which can be a 30 dB couplers, can be operably connected to power meters 1012A and 12012B to enable power meters 1012A and 1012B to measure the power outputted from port 1 and port 4 of combiner 1010.

Figure 11:
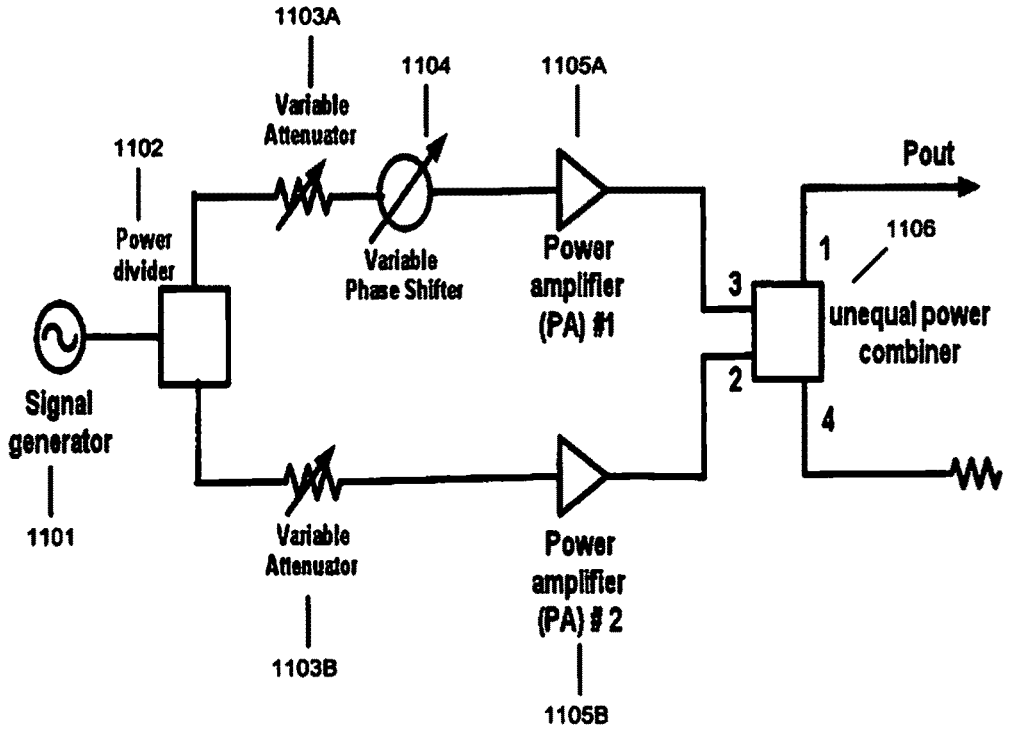
FIG. 11 illustrates a schematic of another 2-way power combining circuit, in accordance with one or more embodiments of the present invention.

FIG. 11 illustrates a schematic of another 2-way power combining circuit, in accordance with one or more embodiments of the present invention. The 2-way power combining circuit includes a signal generator 1101, a power divider 1102, variable attenuators 1103A and 1103B, a variable phase shifter 1104, power amplifiers 1105A and 1105B, and an unequal power combiner 1106 with four ports (i.e., port 1, port 2, port 3, port 4). Power amplifiers 1105A and 1105B are operably connected to port 3 and port 2, respectively. Port 1 is operably connected to a load, such as an antenna, and is configured to output power. Port 4, however, is configured to receive very little or no power as port 4 is match terminated or grounded.

Signal generator 1101 is configured to generate a power signal, which is divided or split into two power signals, a first power signal and a second power signal, by power divider 1102. In order to sufficiently drive power amplifiers 1105A and 1105B, amplitude of the first power signal and the amplitude of the second power signal are adjusted by variable attenuators 1103A and 1103B. Variable phase shifter 1104 is configured to adjust a phase of the amplified first power signal, such that a stronger power signal generated by power amplifier 1105A and a weaker power signal generated by power amplifier 1105B reach unequal power combiner 1106 at the same time.

The stronger power signal and the weaker power signal are transmitted to unequal power combiner 1106, via ports 3 and 2 respectively. Unequal power combiner 1106 is configured to combine the stronger and weaker power signals to generate or produce a maximized power, which is outputted from port 1. Because port 4 is match terminated, negligible or no power flows out of port 4. Stated another way, the circuit illustrated in FIG. 11 shows how two unequal powers generated by power amplifiers can be combined to produce a maximized power while maintaining high efficiency.

Figure 12:
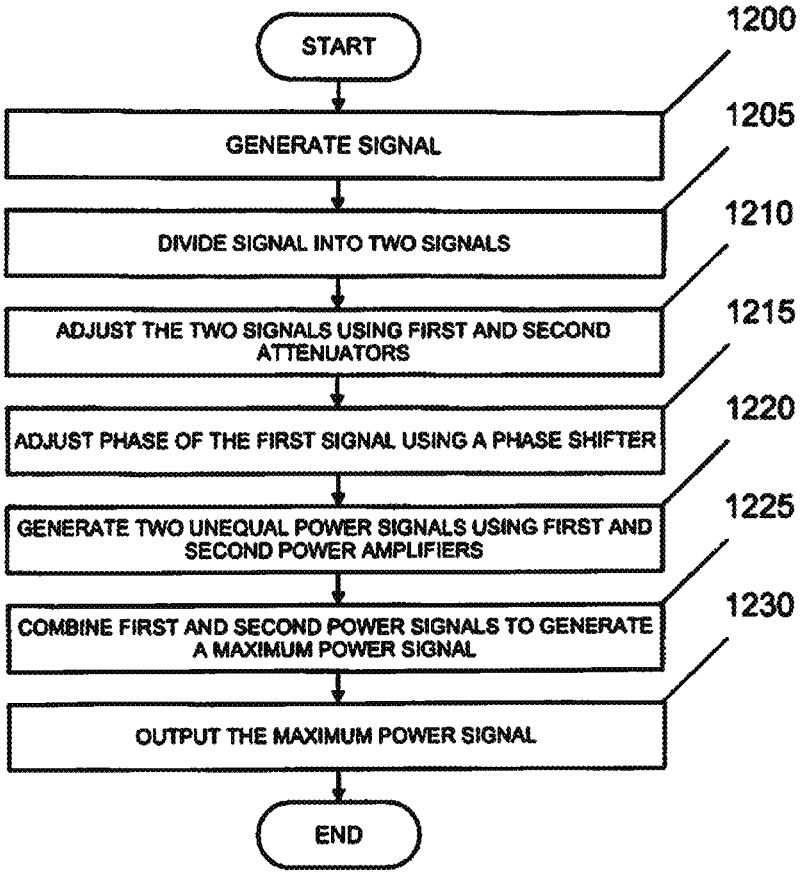
FIG. 12 illustrates a method of combining two powers into one maximized power, in accordance with one or more embodiments of the present invention.

FIG. 12 illustrates a method of combining power, in accordance with one or more embodiments of the present invention. At 1200, a power signal is generated by a signal synthesizer, which is divided into two different power signals (e.g. a first power signal and a second power signal) at 1205. At 1210, a first attenuator and a second attenuator are configured to adjust the amplitude of the first and second power signals, respectively, so that the first and second power signals can provide sufficient power to drive the two unequal power amplifiers. At 1215, a phase shifter adjusts the phase for the first power signal, such that power signals generated by the two amplifiers reach the power combiner with the same phase. At 1220, the first power amplifier is configured to generate a first power that is stronger than a second power that is generated by the second power amplifier. At 1225, the two unequal powers are combined in the power combiner to generate a maximized power. At 1230, the maximized power is outputted through an output port of the power combiner, while negligible power is outputted through an isolated port of the power combiner.

Figure 13:
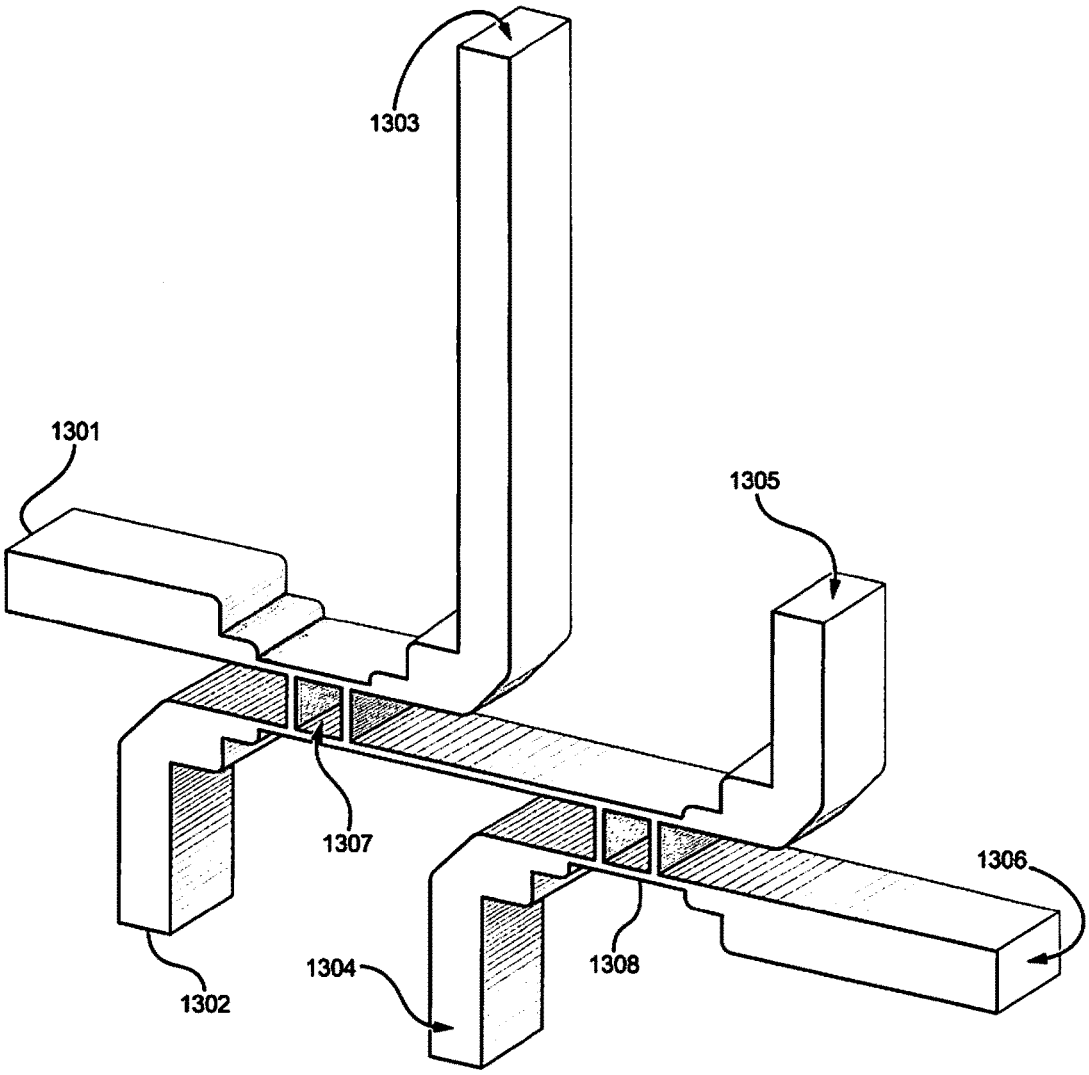
FIG. 13 illustrates a 3-way branch-line power combiner and port configuration, in accordance with another embodiment of the present invention.

FIG. 13 illustrates a 3-way branch-line power combiner and port configuration 1300, in accordance with another embodiment of the present invention. In this embodiment, two 2-way branch-line power combiners are combined in a serial manner. The power combiner 1300 comprises a plurality of ports 1301, 1302, 1303, 1304, 1305 and 1306 and combiners 1307 and 1308. It should be noted that distance of separation between combiners 1307 and 1308 is optimized to maximize power outputted from port 1301. Stated another way, the distance of separation may change in order to achieve the maximum output power from port 1301. Ports 1302 and 1304 are isolated ports, port 1301 is a combined output port, and ports 1303, 1305 and 1306 are input ports. For purposes of simplicity, power ratio of port 1305 and 1306 can be 2:1, and power ratio of port 1303 and combined port 1305/1306 can be 2:1. However, it should be appreciated that the power ratio can be any ratio.

In this embodiment, if 1 watt of power is inputted at port 1306 and 2 watts of power is inputted at 1305, then the two powers are combined at combiner 1308 to produce 3, or approximately 3, watts of power. 6 watts of power is then inputted at port 1303 and combined with the combined power of 3 watts at combiner 1307 to produce a combined power of 9, or approximately 9, watts. The combined power of 9 watts is outputted at port 1301 with very little or no power being outputted at ports 1302 and 1304.

It should be appreciated that the embodiments of the present invention are not limited to a 2-way or a 3-way combiner. But, instead the power combiner can be configured to be a N-way power combiner, where N can be any number.

Figure 14:
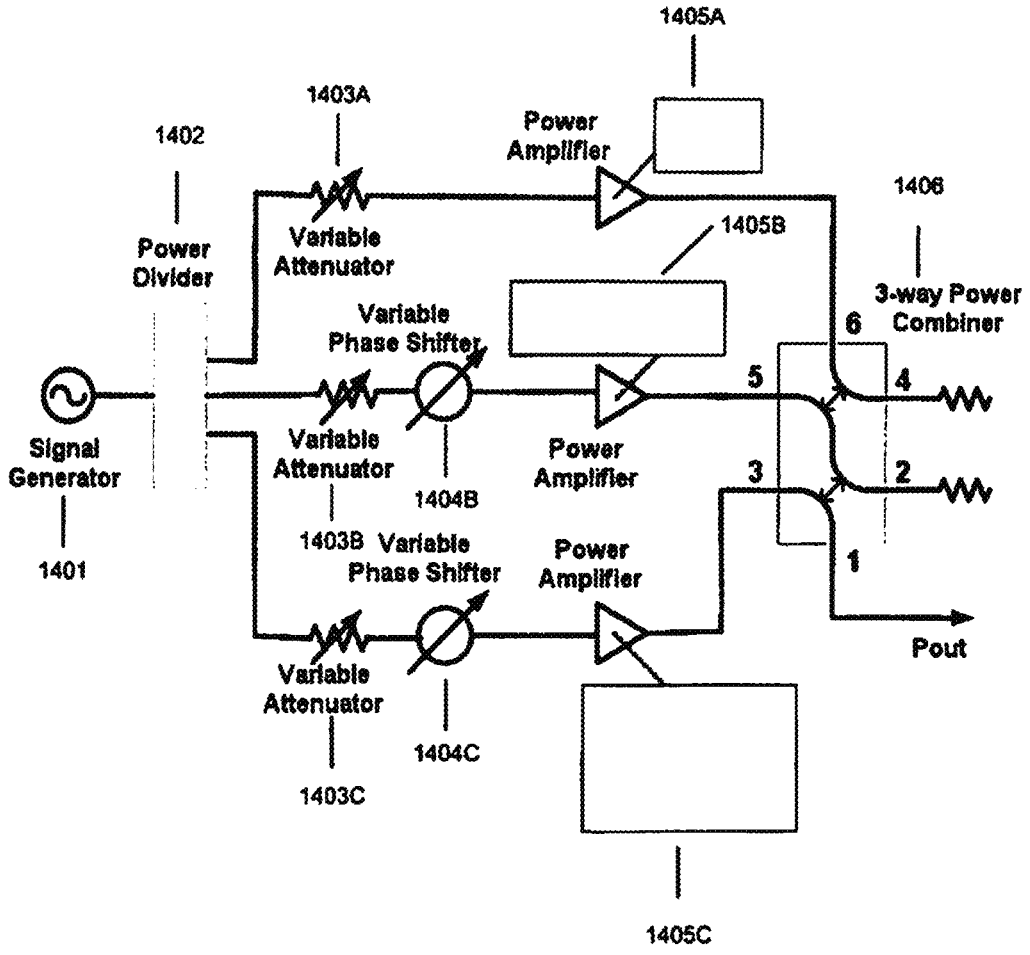
FIG. 14 illustrates a 3-way power combiner demonstration circuit using power amplifiers as in two-way combining circuits, in accordance with one or more embodiments of the present invention.

FIG. 14 illustrates a 3-way power combiner demonstration circuit using the same GaAs pHEMT MMIC power amplifiers as in two-way power combining circuits, in accordance with one or more embodiments of the present invention. The circuit includes a signal generator 1401, a power divider 1402, variable attenuators 1403A, 1403B and 1403C, variable phase shifter 1404B and 1404C, power amplifiers 1405A, 1405B and 1405C, and an unequal power combiner 1406 having 6 ports. Ports 4 and 2 are grounded or match terminated (i.e., isolated) so that very little power or negligible power flows out of ports 4 and 2. Ports 3, 5, and 6 are input ports, and port 1 is an output port.

Signal generator 1401 is configured to generate a power signal. The generated power signal is divided by power divider 1402 into three power signals, i.e., a first power signal, a second power signal, and a third power signal. Variable attenuators 1403A, 1403B and 1403C are configured to adjust amplitudes of the first, second, and third power signals, respectively, so that the first, second, and third power signals can provide sufficient power to drive power amplifiers 1405A, 1405B and 1405C. Variable phase shifters 1404B and 1404C are configured to adjust a phase of the second and third power signals, respectively. As a result, power generated from power amplifiers 1405A, 1405B and 1405C can reach unequal power combiner 1406 at the same time to produce a maximized power.

Power amplifiers 1405A, 1405B and 1405C are configured to generate a first, second, and third power, respectively. Depending on the power ratio, which can be a 2:1 power ratio, the second power will be stronger than the first, and the third power will be stronger than the combination of the first and second powers. The first and second powers generated from power amplifiers 1405A and 1405B are transmitted to unequal power combiner 1406 via ports 6 and 5, respectively. The third power generated from power amplifier 1405C is transmitted to unequal power combiner 1406 via port 3. The first and second powers are combined in unequal power combiner 1406 to produce a combined power. The combined power is then further combined in unequal power combiner 1406 with the third power to produce a maximized power. The maximized power is then outputted from port 1 to a load, which can be an antenna. Because ports 4 and 2 are match terminated, negligible or no power flows out from either ports 4 or 2. Stated another way, the embodiments illustrated in FIG. 14 show how unequal powers generated from three unequal power amplifiers are combined in a 3-way unequal power combiner.

Figure 15:
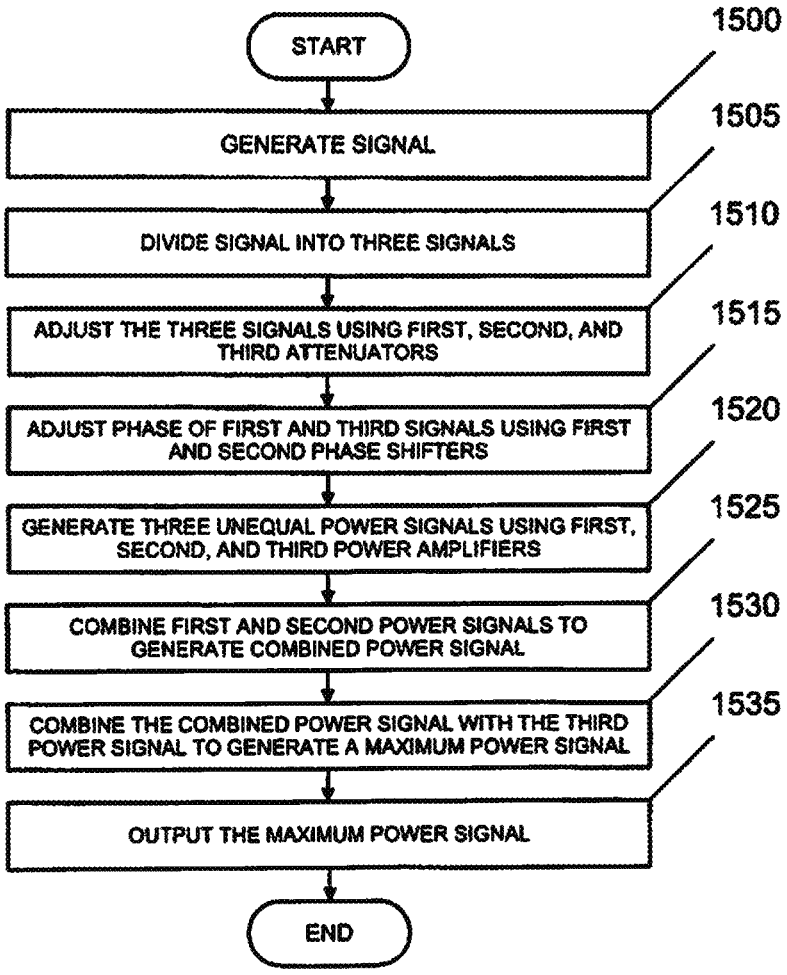
FIG. 15 illustrates a method of combining three powers into one maximized power, in accordance with one or more embodiments of the present invention.

FIG. 15 illustrates a method of combining power, in accordance with one or more embodiments of the present invention. At 1500, a power signal is generated and then divided into three power signals at 1505. At 1510, the amplitude of the first power signal, the amplitude of the second power signal, and the amplitude of the third power signal are adjusted by a first attenuator, a second attenuator, and a third attenuator, respectively. At 1515, a phase of the first power signal and a phase of the third power signal are adjusted by a first phase shifter and a second phase shifter, respectively.

At 1520, a first power signal is generated by a first power amplifier, a second power signal is generated by a second power amplifier, and a third power signal is generated by a third power amplifier. The first, second, and third power signals can be configured to be unequal in strength. The first and second power signals are combined in an unequal power combiner to generate a combined power signal at 1525. At 1530, the combined power signal is further combined in the unequal power combiner with the third power signal to produce a maximized power signal. At 1535, the maximized power signal is outputted to, for example, an antenna.

Figure 16A:
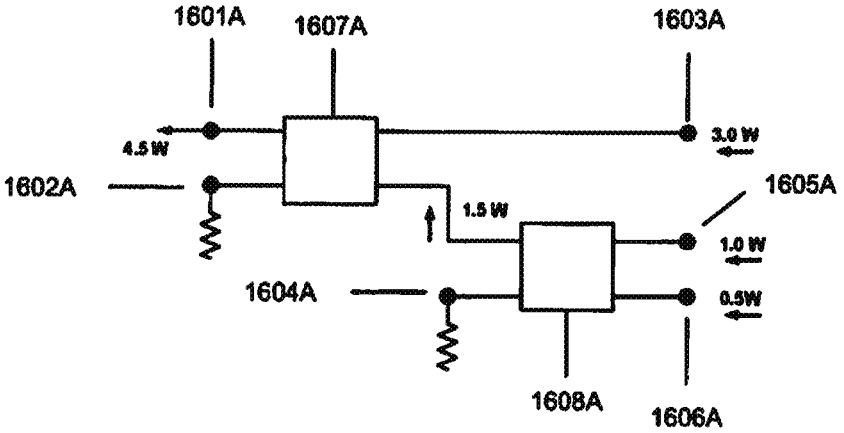
FIG. 16A illustrates serial combining of 2-way unequal power branch-line combiners for an odd number of amplifiers, in accordance with one or more embodiments of the present invention.

FIG. 16A illustrates a serial combining of 2-way unequal power branch-line combiner for an odd number of amplifiers, in accordance with one or more embodiments of the present invention. FIG. 16A illustrates a power combiner 1607A, which is operably connected to a power amplifier 1603A and power combiner 1608A. Power combiner 1608A is operably connected to power amplifier 1605A and power amplifier 1606A. Power combiner 1607A and power combiner 1608A have a 2:1 power ratio. It should be noted that power combiner 1607A is match terminated at 1602A and power combiner 1608A is match terminated at 1604A.

In this embodiment, power amplifier 1605A is configured to generate 1 watt of power and power amplifier 1606A is configured to generate 0.5 watt of power. 1 watt of power and 0.5 watt of power are transmitted to power combiner 1608A. Power combiner 1608A combines the 1 watt of power and the 0.5 watt of power to produce 1.5 watts of power. When the 15 watts of power are transmitted to power combiner 1607A, power amplifier 1603A is configured to generate and transmit 3.0 watts of power to power combiner 1607A. Power combiner 1607A is configured to combine the 1.5 watts of power with the 3.0 watts of power to produce 4.5 watts of power. The 4.5 watts of power is then transmitted to a load 1601A.

Figure 16B:
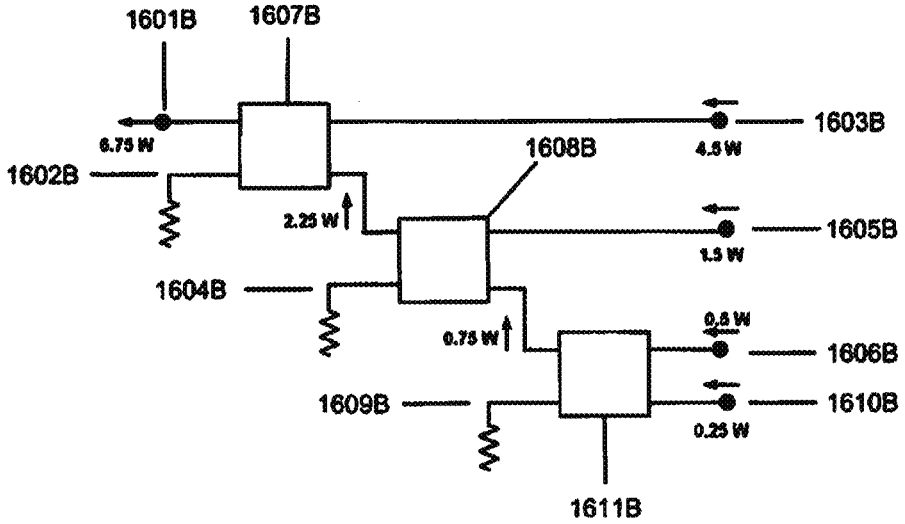
FIG. 16B illustrates serial combining of 2-way unequal power branch-line combiners for an even number of power amplifiers, in accordance with one or more embodiments of the present invention.

FIG. 16B illustrates a serial combining of 2-way unequal power branch-line combiner for even number of power amplifiers, in accordance with one or more embodiments of the present invention. FIG. 16B illustrates a power combiner 1607B, which is operably connected to power amplifier 1603B and power combiner 1608B. Power combiner 1608B is operably connected to power amplifier 1605B and power combiner 1611B. Power combiner 1611B is operably connected to power amplifier 1606B and power amplifier 1610B. It should be noted that power combiner 1607B is match terminated at 1602B, power combiner 1608B is match terminated at 1604B, and power combiner 1611B is match terminated at 1609B.

In this embodiment, power amplifier 1606B generates and transmits 0.5 watts of power to power combiner 1611B, while power amplifier 1610B generates 0.25 watts of power to power combiner 1611B. Power combiner 1611B combines the 0.5 watts of power with the 0.25 watts of power to generate or produce 0.75 watts of power. The 0.75 watts of power are transmitted to power combiner 1608B, while power amplifier 1605B generates and transmits 1.5 watts of power to power combiner 1608B. Power combiner 1608B combines the 1.5 watts of power with the 0.75 watts of power to produce 2.25 watts of power. The 2.25 watts of power are transmitted to power combiner 1607B, while power amplifier 1603B generates and transmits 4.5 watts of power to power combiner 1607B. Power combiner 1607B combines the 45 watts of power with the 2.25 watts of power to produce 6.75 watts of power. The 6.75 watts of power can then be transmitted to a load 1601B.

The concept of a serial power combiner as illustrated in FIGS. 16A and 16B are for two cases, namely, odd and even number of amplifiers. A major advantage of serial power combining is the ability to produce non-binary power combiners. This scheme allows the output power from any odd or even number of amplifiers to be combined. Therefore, the serial power combining technique enables an economical way to achieve the required total output power with the minimum number of amplifiers.

The method steps performed in FIGS. 12 and 15 may be controlled, managed, or performed, at least in part, by a computer program product, encoding instructions for a nonlinear adaptive processor to cause at least the methods described in FIGS. 12 and 15 to be performed by the apparatuses discussed herein. The computer program product may be embodied on a computer-readable medium. The computer-readable medium may be, but is not limited to, a hard disk drive, a flash device, a random access memory, a tape, or any other such medium used to store data. The computer program product may include encoded instructions for controlling the nonlinear adaptive processor to implement the method described in FIGS. 12 and 15, which may also be stored on the computer-readable medium.

As such, the computer program product can be implemented in hardware, software, or a hybrid implementation. The computer program product can be composed of modules that are in operative communication with one another, and which are designed to pass information or instructions to a display. The computer program product can be configured to operate on a general purpose computer, or an application specific integrated circuit ("ASIC").

The embodiments of the present invention describe a novel unequal power combiner with an arbitrary power combining ratio and port impedance. These features result in several advantages, which are as follows. First, the design is very flexible, which enables a power combiner to be customized for combining the power from MMIC PAs with arbitrary power output ratios and combining a low power GaAs MMIC with a high power GaN MMIC. Second, the arbitrary port impedance enables matching the output impedance of the MMIC PA directly to the waveguide impedance without transitioning first into a transmission line with characteristic impedance of 50 ohms. Thus, by eliminating the losses associated with a transition, the overall SSPA efficiency is enhanced. Third, for reducing the cost and weight when required in very large quantities, such as in the beam forming networks of phased array antenna systems, the power combiner can be manufactured using metal-plated plastic. Fourth, two hybrid unequal power combiners can be cascaded to realize a non-binary combiner (e.g., a 3-way power combiner) and can be synergistically optimized for low VSWR, low insertion loss, high isolation, and wide bandwidth using modern software design tools.

It should be appreciated that the invention as discussed above may be practiced with steps in a different order, and/or with hardware elements in configurations that are different than those specifically disclosed. As such, although the present invention has been described based upon the foregoing embodiments, modifications, variations, and alternative constructions may be made, while still remaining within the scope of the present invention. In order to determine the metes and bounds of the invention, therefore, reference should be made to the appended claims.

We claim:

1. An apparatus, comprising:

an input port configured to receive input power from a high frequency Ka-band or higher power amplifier;

first and second output ports configured to output power;

a power divider with no differential phase shifter and no septum polarizer configured to divide the received input power from the input port between the first and the second output ports; and an isolated port configured to receive negligible or no power from the divider, wherein the isolated port is grounded or match terminated; and wherein the power at the first and the second output ports are unequal and further wherein the divider can divide with both integral and non-integral power ratios including any arbitrary ratio of unequal output powers.

2. The apparatus of claim 1, wherein:

the first output port is operably connected to a second divider and the second output port is operably connected to a third divider;

the second divider and the third divider are configured to simultaneously receive power;

the second divider is configured to divide the power from the input port and produce a third and a fourth output power;

the third divider is configured to divide the power from the input port and produce a fifth and a sixth output power; and the third and fourth output powers are unequal and the fifth and sixth output powers are unequal.

3. The apparatus of claim 2, wherein the third and fourth output powers are outputted from the third and fourth output ports to loads or to a fourth and a fifth divider or antennas; and the fifth and sixth output powers are outputted from the fifth and sixth output ports to loads or to a sixth and a seventh divider or antennas.

4. The apparatus of claim 2, wherein a second isolated port and a third isolated port are configured to receive negligible power or no power from the second and third dividers, wherein the second and third isolated ports are grounded or match terminated.

5. The apparatus of claim 1, wherein the first and the second output ports are operably connected to loads or antennas.

6. A method, comprising:

receiving at an input port, power from a power amplifier at Ka-band or higher frequency;

configuring a first output port and a second output port to output powers;

configuring a power divider with no differential phase shifter and no septum polarizer to divide the received input power between the first and the second output ports;

receiving, at an isolated port, negligible or no power from the divider; and wherein the first output power and the second output power are unequal and further wherein the divider can divide both integral and non-integral power ratios including any arbitrary ratio of unequal output power.

7. The method of claim 6, further comprising outputting the divided powers from the first divider to a second divider and a third divider, via output ports;

simultaneously receiving the divided powers at inputs of the second and third dividers; and dividing, at the second divider and producing a third and fourth output powers and dividing at the third divider and producing a fifth and sixth output powers, wherein the third and fourth output powers are unequal and the fifth and sixth output powers are unequal.

8. The method of claim 7, further comprising:

outputting the third and the fourth output powers from the second divider to loads or additional power dividers or antennas; and outputting the fifth and the sixth output powers from the third divider to loads or additional power dividers or antennas.

9. The method of claim 7, further comprising:

receiving, at the second and third isolated ports, negligible power or no power from the second and third dividers.

10. The method of claim 6, further comprising:

outputting the divided power from the divider to a load, via output ports.

11. An apparatus, comprising:

a divider, with no differential phase shifter and no septum polarizer, comprising an input port, two output ports, and an isolated port, wherein the divider is configured to receive a high frequency Ka-band or higher power from a power amplifier, via the input port, and divide the input power into two output powers and make them available via the two output ports, wherein the divider can divide both integral and non-integral power ratios including any arbitrary ratio of unequal output power; and wherein the divider is further configured to output the divided powers to a second divider and a third divider, via the output ports of the divider.

12. The apparatus of claim 11, wherein the second and third dividers are configured to simultaneously receive the divided powers from the divider, via input ports of the second and the third dividers, wherein divided powers at outputs of the second and third dividers are unequal.

13. The apparatus of claim 12, wherein the second divider and the third divider are further configured to divide the power into both integral and non-integral power ratios including any arbitrary ratio of unequal output power.

14. The apparatus of claim 12, wherein the second and third dividers are further configured to output the divided powers to an additional divider or a load via output ports of the second and third dividers, and output negligible or no power via isolated ports of the second and third dividers.

15. The apparatus of claim 11, wherein the divider is further configured to output negligible or no power via the isolated port of the divider.

16. The apparatus of claim 11, wherein the divider is further configured to output the divided powers to loads, via the output ports of the divider.

* * * * *